US011333354B2

(12) United States Patent
Santos Fuertes

(10) Patent No.: US 11,333,354 B2
(45) Date of Patent: May 17, 2022

(54) SYSTEM FOR WASTE TREATMENT

(71) Applicant: AF INGENIERIA, S.L., Valencia (ES)

(72) Inventor: José Santiago Santos Fuertes, Valencia (ES)

(73) Assignee: AF INGENIERIA, S.L., Valencia (ES)

( * ) Notice: Subject to any disclaimer, the term of this patent is extended or adjusted under 35 U.S.C. 154(b) by 170 days.

(21) Appl. No.: 16/495,912

(22) PCT Filed: Mar. 8, 2018

(86) PCT No.: PCT/ES2018/070174
§ 371 (c)(1),
(2) Date: Sep. 20, 2019

(87) PCT Pub. No.: WO2018/172577
PCT Pub. Date: Sep. 27, 2018

(65) Prior Publication Data

US 2020/0041123 A1 Feb. 6, 2020

(30) Foreign Application Priority Data

Mar. 24, 2017 (ES) ..... ES201730412
Nov. 16, 2017 (ES) ..... ES201731399U

(51) Int. Cl.
*F23G 5/027* (2006.01)
*F23B 50/08* (2006.01)
(Continued)

(52) U.S. Cl.
CPC ..... *F23G 5/027* (2013.01); *F23B 50/08* (2013.01); *F23G 5/10* (2013.01); *F23G 5/24* (2013.01);
(Continued)

(58) Field of Classification Search
CPC .... F23G 2201/30; F23G 2201/40; F23G 5/26; F23G 5/28; F23B 50/02; F23B 50/04; F23B 50/08; F23B 50/12
See application file for complete search history.

(56) References Cited

U.S. PATENT DOCUMENTS 1,091,736 A * 3/1914 Doyle ..... F23G 5/027 110/229
4,156,394 A * 5/1979 Mallek ..... C10B 1/04 110/346
(Continued)

FOREIGN PATENT DOCUMENTS

EP 1201993 A1 5/2002
GB 2472610 A 2/2011
(Continued)

*Primary Examiner* — David J Laux
(74) *Attorney, Agent, or Firm* — Hayes Soloway P.C.

(57) ABSTRACT

A waste treatment unit. It comprises at least one gasifier having a main receptacle (1) with a waste inlet (2), a syngas outlet (6) and an ashtray outlet (8). In the interior of the receptacle there is a body (4) with at least one inclined section (7) disposed opposite to the waste inlet (2), and with a base (14) which creates a depletion shaft (17) that prevents the passage of waste; and a dividing wall (9*a*) in contact with said body (4) or an evacuation tube (9*a*) in the interior of the body (4), such as to create a waste zone (15) that encompasses at least the zone where the inclined section (7) is located, and a waste-free zone (16) wherethrough the syngas produced during oxidation of the waste flows towards the syngas outlet (6).

13 Claims, 11 Drawing Sheets

(51) Int. Cl.
*F23G 5/10* (2006.01)
*F23G 5/24* (2006.01)

(52) U.S. Cl.
CPC .... *F23G 2201/40* (2013.01); *F23G 2204/204* (2013.01)

(56) References Cited

U.S. PATENT DOCUMENTS

| | | | | |
|---|---|---|---|---|
| 5,000,101 | A * | 3/1991 | Wagner | F23G 5/0276 110/204 |
| 2001/0029005 | A1* | 10/2001 | Piringer | F23B 1/36 432/19 |
| 2008/0063578 | A1* | 3/2008 | Molohon | F23G 5/10 422/186.18 |

FOREIGN PATENT DOCUMENTS

| | | | |
|---|---|---|---|
| WO | 2015018742 | A1 | 2/2015 |
| WO | 2015050493 | A1 | 4/2015 |

* cited by examiner

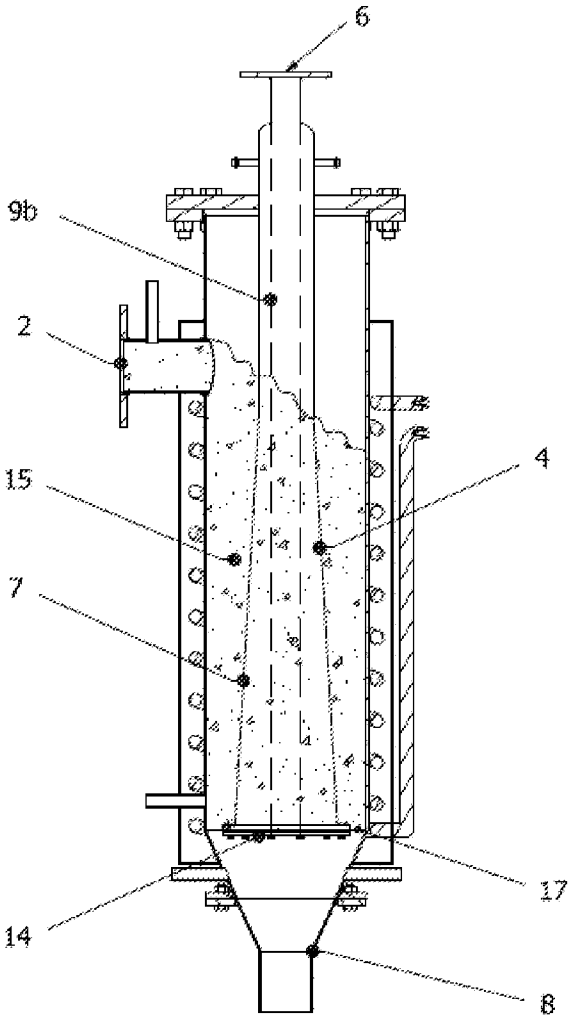
FIG. 1
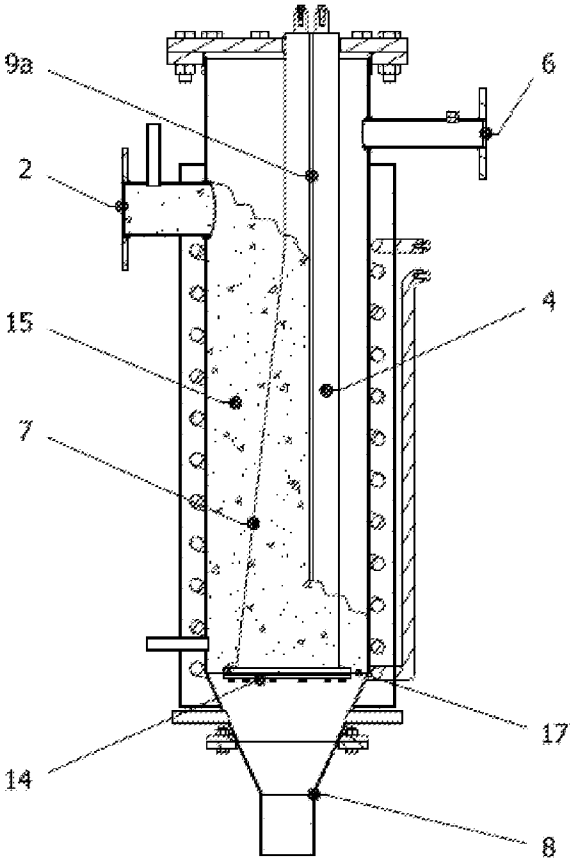

SYSTEM FOR WASTE TREATMENT

CROSS-REFERENCE TO RELATED APPLICATIONS AND PRIORITY

This patent application claims priority from PCT/ES2018/070174 filed Mar. 8, 2018, which claims priority from ES Patent Application No. U201731399 filed Nov. 16, 2017 and from ES Patent Application No. P201730412 filed Mar. 24, 2017. Each of these patent applications are herein incorporated by reference in its/their entirety.

DESCRIPTION

Object of the Invention

The present invention falls within the technical field of waste treatment units and, more specifically, units comprising gasifiers.

Background of the Invention

Gasification is a thermochemical process whereby a mixture of combustible gas is obtained from organic matter. The mixture of combustible gas comprises mainly CO, $CO_2$, $H_2$, $CH_4$, some heavy carbohydrates such as $C_2H_4$ and $C_2H_6$, and water. Likewise, some pollutants such as char, ashes and asphalts are generated during gasification.

Various types of gasifiers such as, for example, fluidised bed gasifiers, which include a pump variant, are known in the state of the art. These types of gasifiers produce impure gas, with a high degree of drag of ashes and combustibles. Therefore, these gasifiers require operation under recycle (recirculating very hot gas to remove the bed) or supplying very hot air which adds nitrogen to the syngas current. This nitrogen addition to the syngas current poses a major technical problem, since said gas is inert and consumes energy in subsequent processes that take place in the gasifier.

Likewise, rotary pyrolysers that require operation under depression, since their rotary seals and expansion systems do not tolerate overpressure due to risk of fire, are known in the state of the art. This causes a high degree of drag of combustibles and ashes, and these pyrolysers also have difficulty in thermally regulating the process due to their large volume.

Furthermore, fluidised bed gasifiers with bed poisoning drawbacks, bed loss due to ash emulsion and difficulty in agitating the bed, even in small-scale gasifiers, are known in the art.

Another, alternative solution is that of plasma pyrolysers, which have excessive consumption and add $N_2$ to the syngas current. They require maintenance, with replacement of fungibles, in very short time periods, and have excessively high cost. These types of pyrolysers are generally used to destroy hazardous waste in those cases where the economic costs are not so relevant and where waste recovery is not possible. They operate at very high temperatures, their process is at a high energy cost, they are inefficient and the quality of the gas is also affected by the presence of nitrogen which, at operating temperatures, can lead to the formation of $NO_2$.

DESCRIPTION OF THE INVENTION

The waste treatment unit of the present invention enables humid phase waste recovery through a gasification thereof to obtain syngas.

The waste that can be introduced in the described unit includes, for example, residual plastic, biomass, used mineral oil, plastics mixed with cellulose (paper industry waste), plastics mixed with textiles and used tyres. It is also especially convenient for treating solid urban waste by-products (combustibles derived from recovered solid waste and combustibles), the composition of which essentially comprises 50% of plastic and paper.

A key factor of the present invention is that it allows treatment of waste in the humid phase. As described earlier, the treatment units of the state of the art require the waste to be in the dry phase to guarantee heat transfer.

The unit of the present invention enables the treatment of waste with up to 45% in the humid phase to achieve hydrogasification (water vapour is the oxidising agent). This avoids having to perform an intermediate waste drying stage which was essential for the proper functioning of the gasifiers of the state of the art. This drying stage is essential in the state of the art to ensure that the temperature of the gasifier increases to the temperature necessary for gasification without producing alterations in the different reactions.

In the present invention, the unit comprises at least one gasifier, the interior of which is at a temperature of less than 500° during operation of the unit (against a working temperature of approximately 700° in the gasifiers of the state of the art). This also represents an additional advantage, since this temperature, due to being lower, is easier to reach and maintain. It also decreases the risk of condensation of asphalts.

The gasifier comprises a main receptacle with a waste inlet disposed in the upper section of the receptacle, a syngas outlet and an ashtray outlet. The interior of the receptacle is configured such that the syngas generated during oxidation of the waste is forced towards the outlet without passing through said waste, thereby avoiding possible ash drag.

To this end, in the interior of the receptacle there is a body having at least one inclined surface whereon the waste introduced in the gasifier accumulates and, in a first embodiment, comprises a dividing wall in the interior of the receptacle in contact with the body and, in a second embodiment, comprises an evacuation tube in the interior of the body. These elements separate a waste accumulation zone (corresponding, at least, to said inclined body section) and a waste-free zone wherethrough the syngas generated flows towards the outlet.

The flow of materials circulates in a downward direction, aided by gravity. The slip angle of the inclined surface of the body is defined by the type of material and residence time required to complete the process. The syngas produced circulates through the waste-free zone towards the syngas outlet. Said outlet is preferably situated in the upper section of the receptacle wherethrough the gas circulates in an upward direction through said waste-free zone. In the first embodiment, the syngas circulates in an upward direction through the waste-free zone forced by the dividing wall. In the second embodiment, the syngas circulates in an upward direction through the evacuation tube, which is free of waste.

In the first embodiment, wherein the gasifier comprises a dividing wall, the syngas outlet may be disposed on the lower section of the receptacle. In this case, the gasifier works co-currently, since the syngas is extracted from below and therefore follows the same direction of circulation of the waste.

In the second embodiment, wherein the gasifier comprises an evacuation tube, the body is preferably a concentric cone having inclined walls whereon the waste introduced in the gasifier is accumulated. The revolution body further comprises a base around which narrowing occurs with respect to the receptacle walls. The evacuation tube comprises a first end corresponding to the syngas outlet and a second end in the base of the body. Said evacuation tube penetrates the revolution body wherethrough the syngas generated passes from the base of the body to the syngas outlet through the interior of the body without coming into contact with the waste (waste-free zone).

As previously described, the flow of the materials of the waste to be treated circulates in a downward direction, the same as the oxidation reaction of said waste that generates the syngas, which moves towards the lower zone of the receptacle, which is free of waste. The heat generated in this reaction makes it possible to increase the temperature in the interior of the receptacle and generates a downward heat transfer (the direction of movement of the syngas generated).

In the second embodiment, the syngas produced circulates through the evacuation tube in the interior of the cone towards the syngas outlet. Said outlet is situated in the upper section of the receptacle, due to which the gas circulates in an upward direction, through the revolution body. This enables efficient heat transfer, since the syngas produced ascends through the evacuation tube, which is disposed in the interior of the revolution body, in the interior of the receptacle, transferring thermal energy to the interior of the receptacle, where the waste is located. Likewise, the syngas generation reaction occurs in a downward direction, in the interior of the receptacle, outside of the revolution body and flows in a downward direction towards the waste-free zone in the lower part of the gasifier.

The water vapour present in the waste is used in the present invention as an oxidising agent. In this case the use of air as an oxidising agent has been ruled out because it implies the introduction of $N_2$, as its $O_2$ content is 20% compared to 78% of $N_2$ and it does not intervene in the reactions that occur during gasification, since it is an inert gas. In the present invention, the appearance of $N_2$ would imply an additional energy cost because it would have to be removed, or otherwise it would imply an energy cost in the different phases of syngas treatment by compression. Additionally, $NO_x$-type compounds could be produced during the syngas reforming phase, which would imply an environmental problem to be solved through additional treatment costs.

However, water vapour is produced in the interior of the gasifier through an endothermal reaction. This contributes to the final self-thermal balance of the unit and helps towards what is intended to be achieved in the gasifier, which consists of obtaining end products as similar as possible to a combination of CO and hydrogen.

The syngas obtained in the gasifier can be used as a synthetic fuel and fuel additive, to produce energy, to produce liquid and technical solvents, and to produce thermal energy.

One of the essential advantages of the gasifier of the present invention is that it works by gravity to avoid dragging volatiles. Likewise, in a preferred embodiment of the invention, the gasifier comprises heating means in the interior and exterior of the receptacle to correctly control and unify the temperature.

The syngas obtained is free from drag (due to the fact that, as previously described, the gasifier works by gravity and the syngas does not penetrate the waste in its outflow direction). Additionally, since it enables the use of humid phase waste, the syngas obtained has a high CO and $H_2$ content.

In an exemplary embodiment, the gasification unit additionally comprises a reformer. Said reformer is joined to the syngas outlet of the gasifier.

Preferably, the reformer comprises means for generating a plasma in its interior and ionising the syngas that passes through its interior to obtain a purer syngas at the outlet of the gasification unit, converting the heaviest hydrocarbons generated in the gasification to simpler compounds or elements, mainly CO and $H_2$.

The invention enables adaptation to different waste morphologies. To this end, the morphology of each kind of waste must be previously characterised, since each waste composition has an ideal repose/slip angle. In accordance with this data, the gasifier is designed so that waste may flow due to gravity without forming domes that interrupt circulation.

In an example wherein the gasifier comprises an evacuation tube and the body is a concentric cone, the gasifier can comprise two waste inlets. This makes it possible to maximise the capacity of the gasifier and is especially useful when the receptacle has a large volume. On the one hand, the entire volume in the interior of the receptacle can be better controlled to prevent unused space in the zone farthest from the inlet from becoming filled with waste. That is, an even distribution of the waste inside the receptacle is achieved.

On the other hand, having various waste inlets makes it possible to fill the interior of the receptacle in a continuous manner. Filling can be controlled in order to do so from alternate waste inlets, without having to wait for the waste to settle in the interior of the receptacle to continue filling it.

This also allows the supply units connected to the inlet of the gasifier to be smaller when the gasifier is installed in a waste treatment plant. Since there are several, it is not necessary to have such a large volume of waste in each gasifier.

The gasifier further comprises heating means, which may be internal or external, and which are intended for increasing the temperature in the interior of the receptacle to achieve the gasification of the waste introduced therein.

The gasifier of the waste treatment unit is configured to facilitate the gradual increase in thermal operating range without generating stress zones in the revolution body and in the receptacle. This makes it possible to increase the versatility of the gasifier with respect to other waste treatment units of the state of the art with a more limited temperature range control.

Likewise, the geometry of the gasifier and of the revolution body disposed in its interior makes it possible to achieve a modulation in temperature which allows a more homogeneous distribution of heat over the waste to be treated. This contributes to improving the energy efficiency of the unit. As such, a reduction in energy consumption is achieved, thereby cheapening the process.

The second embodiment, compared to the first embodiment of the gasifier, makes it possible to remove dead zones in the interior of the receptacle. Specifically, in the first embodiment, a dead zone can be created in the rear part of the dividing wall in the interior of the gasifier receptacle. Said dead zone coincides with the zone wherethrough the syngas passes towards the exterior of the receptacle in the cited patent, generating minor energy inefficiencies. The reason is that the dead zone created undermines the capacity of the unit, reducing its working volume, with respect to the specific gasification process.

Another advantage of the second embodiment compared to the first embodiment is that it facilitates the installation of the instrumentation and control systems of the gasification process. Additionally, possible interferences in their signals due to thermal changes in the zones of the interior of the receptacle that are not covered by waste (and therefore create dead zones) are avoided. This also simplifies data collection for controlling said instrumentation and, therefore, the process itself, gaining functionality.

Likewise, the components of the gasifier in the second embodiment are easier to manufacture, since their configuration adapts well to mechanical forming (the revolution body, due to being symmetrical with respect to its longitudinal axis, can be formed in any common machine tool without need to do it manually) and is easy to install; additionally, when the heating systems are disposed in the interior of the revolution body, they are easier to design and manufacture than in the first embodiment.

The working volume ratio of the gasifier, the possibility of adequately modulating the temperatures and the possibility of dual or multiple feed makes it possible to improve leeway in the management of process residence time. Therefore, the gasifier, once installed at a waste treatment facility, makes it possible to improve the continuity of the waste treatment process, thereby improving the quality of the syngas obtained during gasification with respect to the gasification carried out using other unit known in the state of the art.

BRIEF DESCRIPTION OF THE FIGURES

As a complement to the present description, and for the purpose of helping to make the characteristics of the invention more readily understandable, in accordance with a preferred practical exemplary embodiment thereof, said description is accompanied by a set of drawings constituting an integral part of the same, which by way of illustration and not limitation represent the following:

FIG. 1 shows a view wherein two embodiments of the gasifier can be observed, one in which it comprises a dividing wall and another in which it comprises an evacuation tube.

PREFERRED EMBODIMENT OF THE INVENTION

Figure 2A:
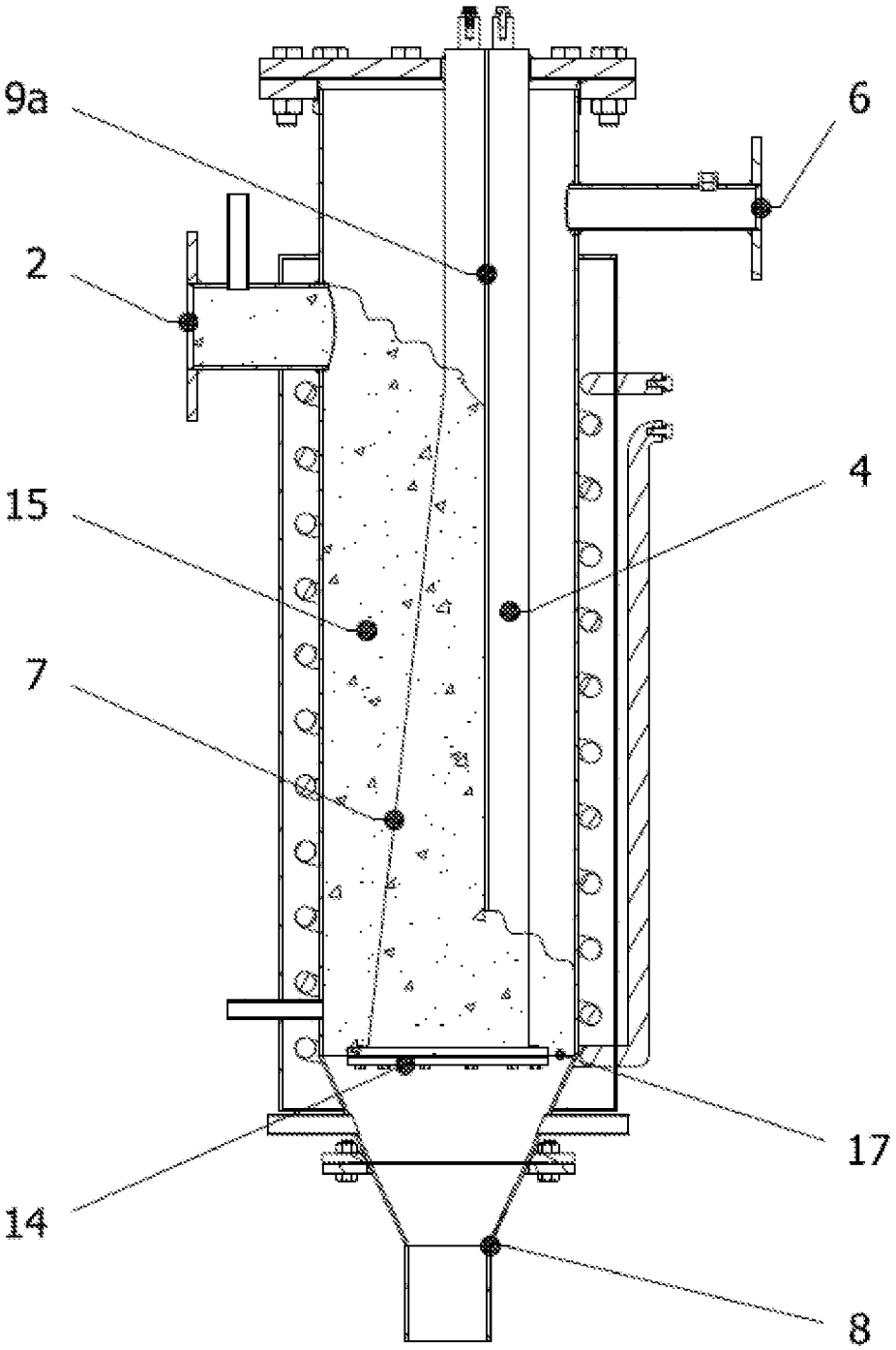
FIG. 2A shows a cross-sectional view of the gasifier in the embodiment wherein it comprises a dividing wall.

What follows is a description, with the help of FIGS. 1 to 9, of exemplary embodiments of the present invention.

The proposed gasification unit is of the type comprising at least one gasifier having a main receptacle (1) with a waste inlet (2) disposed in the upper section of the receptacle, a syngas outlet (6) and an ashtray outlet (8). The solid waste products are collected by the ashtray outlet (8). In FIG. 1, two possible embodiments of the gasifier of the invention can be observed.

The waste is introduced in the gasifier through the corresponding waste inlet (2) and is heated in the interior of the receptacle (1) to trigger the corresponding chemical reactions that generate syngas and ashes as a result. An essential advantage of the present invention is that the gasifier is configured such that the syngas generated does not penetrate the waste as it circulates through the interior of the receptacle (1) towards the syngas outlet (6).

In order to achieve said technical effect, the gasifier comprises, in the interior of the receptacle (1), a body (4) with at least one inclined surface (7). Both the body (4) and the inclined surface (7) can be clearly seen in FIG. 1. It can also be clearly seen in FIGS. 2A-2B, wherein the two possible embodiments of the gasifier can be observed in greater detail.

The body (4) is positioned such that at least one inclined surface (7) is disposed opposite to the waste inlet (2). This allows the waste to fall on said inclined surface (7) of the body (4) disposed opposite to the waste inlet (2) as it is introduced.

Figure 2B:
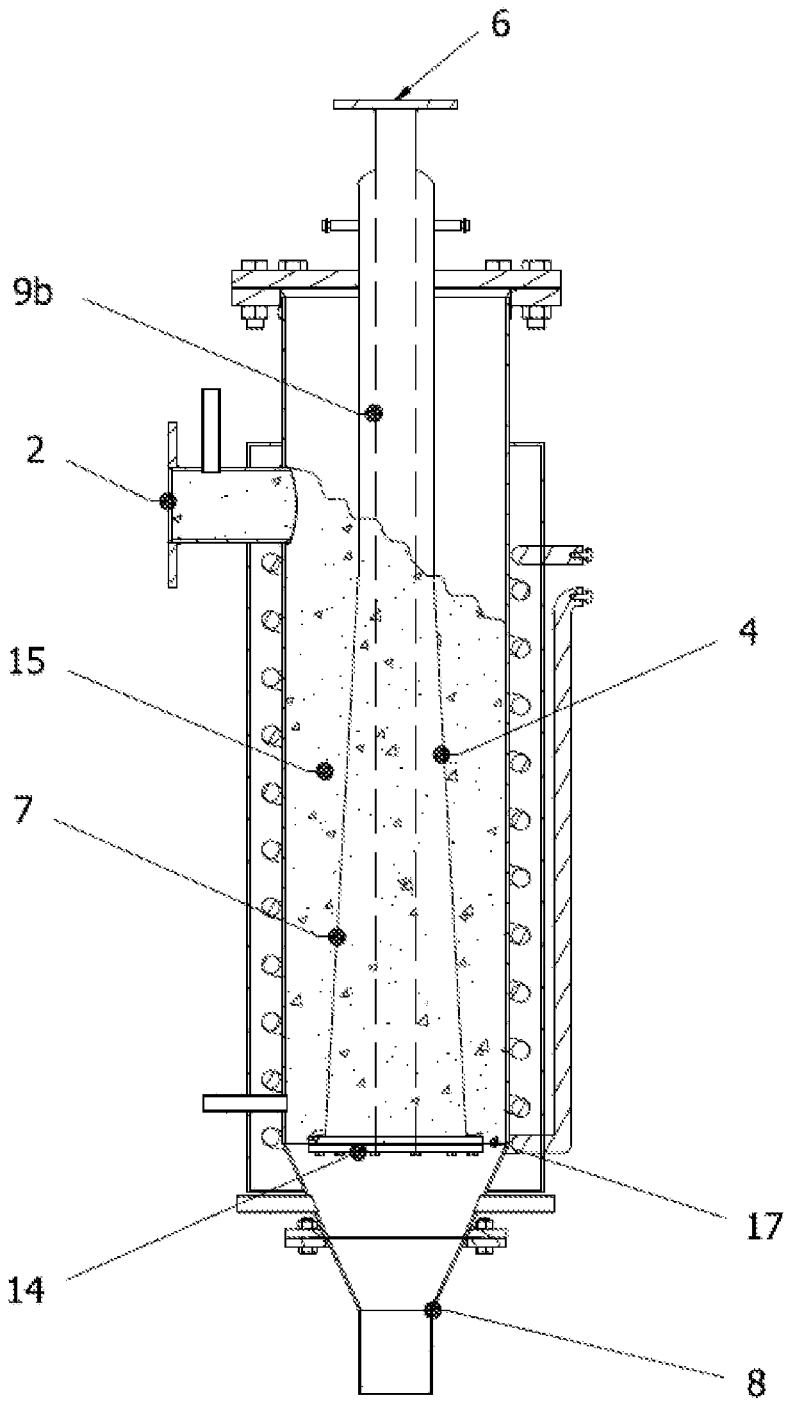
FIG. 2B shows a cross-sectional view of the gasifier in the embodiment wherein it comprises an evacuation tube.
Figure 3A:
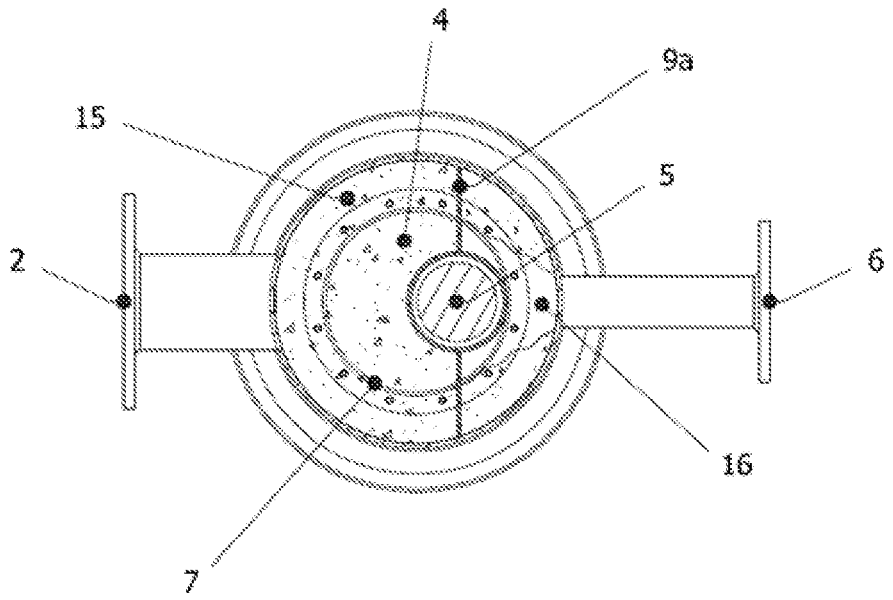
FIG. 3A shows a cross-sectional top view of the gasifier of FIG. 2A with waste in its interior and wherein the waste-free zone can be observed.
Figure 3B:
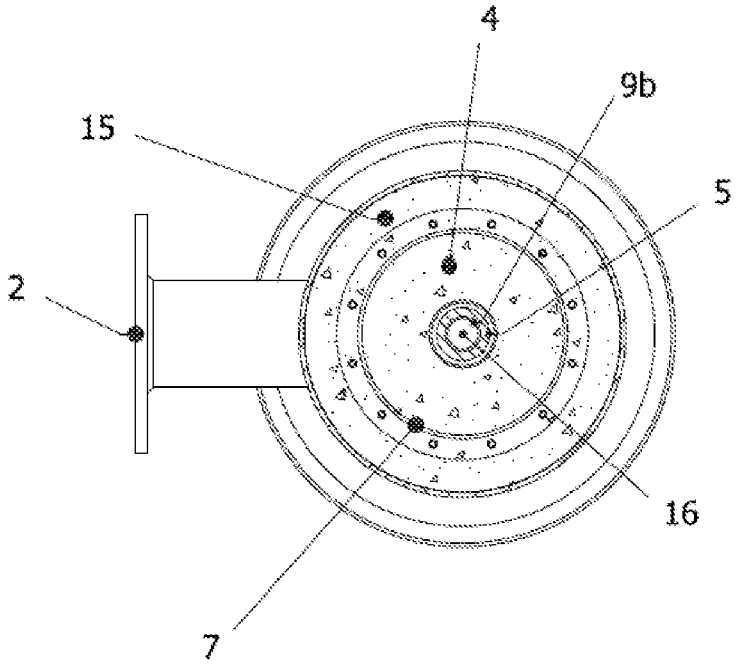
FIG. 3B shows a cross-sectional top view of the gasifier of FIG. 2B with waste in its interior and wherein the waste-free zone can be observed.

In the first embodiment, shown in FIG. 2A, the body (4) is preferably an eccentric cone-shaped body and, in the second embodiment, shown in FIG. 2B, it is preferably a concentric cone-shape body. In both cases, the body (4) comprises a base (14) disposed in such a manner as to generate a depletion shaft (17) between said base (14) and the walls of the receptacle (1) which prevents the passage of waste. This contributes to the accumulation of waste in the desired zones in the interior of the receptacle (1). The free space from the depletion shaft (17) to the ashtray outlet (8) is intended for the passage of the ashes generated during the oxidation of the waste in the interior of the receptacle (1).

An essential technical characteristic of the gasifier is that it comprises, in the interior of the receptacle (1), an element that ensures that the syngas flows out through a zone free from waste and free from by-products that can contaminate it. In the first embodiment, said element is, as shown in FIG. 2A, a dividing wall (9*a*) which is in contact with the body (4). In this case, a cross-sectional view of the gasifier from the waste inlet (2) is shown. As can be seen, the dividing wall (9) is preferably disposed opposite to said waste inlet (2). In the second embodiment, the element that ensures the outflow of waste-free syngas is an evacuation tube (9*b*), which comprises a first end disposed corresponding to the syngas outlet (6) of the gasifier and a second end disposed in the base (14) of the revolution body (4).

The essential advantage of the dividing wall (9*a*) and the evacuation tube (9*b*) is that they separate a waste zone (15) in the receptacle (1), which encompasses at least the zone wherein the inclined surface (7) of the body (4) is located and wherein the waste that enters through the waste inlet is accumulated, from a waste-free zone (16) wherethrough the syngas flows out of the receptacle (1). These waste zones (15) and waste-free zones (16) are clearly observed in FIGS. 3A-B.

Preferably, in the first embodiment (shown in FIGS. 2A, 3A, 4 and 5) the length of the dividing wall (9*a*) is chosen based on the angle of repose on the inclined surface (7) of the body (4) of the waste to be treated. In FIG. 2A it can also be observed how the waste is retained in the depletion shaft (17).

Likewise, the dividing wall (9*a*) creates a waste-free zone (16) wherethrough the syngas produced during oxidation of the waste flows towards the syngas outlet (6). Said waste-free zone (16) can be observed in FIG. 2B. Sealing by filling must be guaranteed such as to force the syngas to move through said waste-free zone (16).

Preferably, as can be seen in the figures, in the first embodiment and, more specifically, when the body (4) is an eccentric cone-shaped body, the waste zone (15) encompasses the entire inclined surface (7) and part of the straight section of the body (4).

Figure 4:
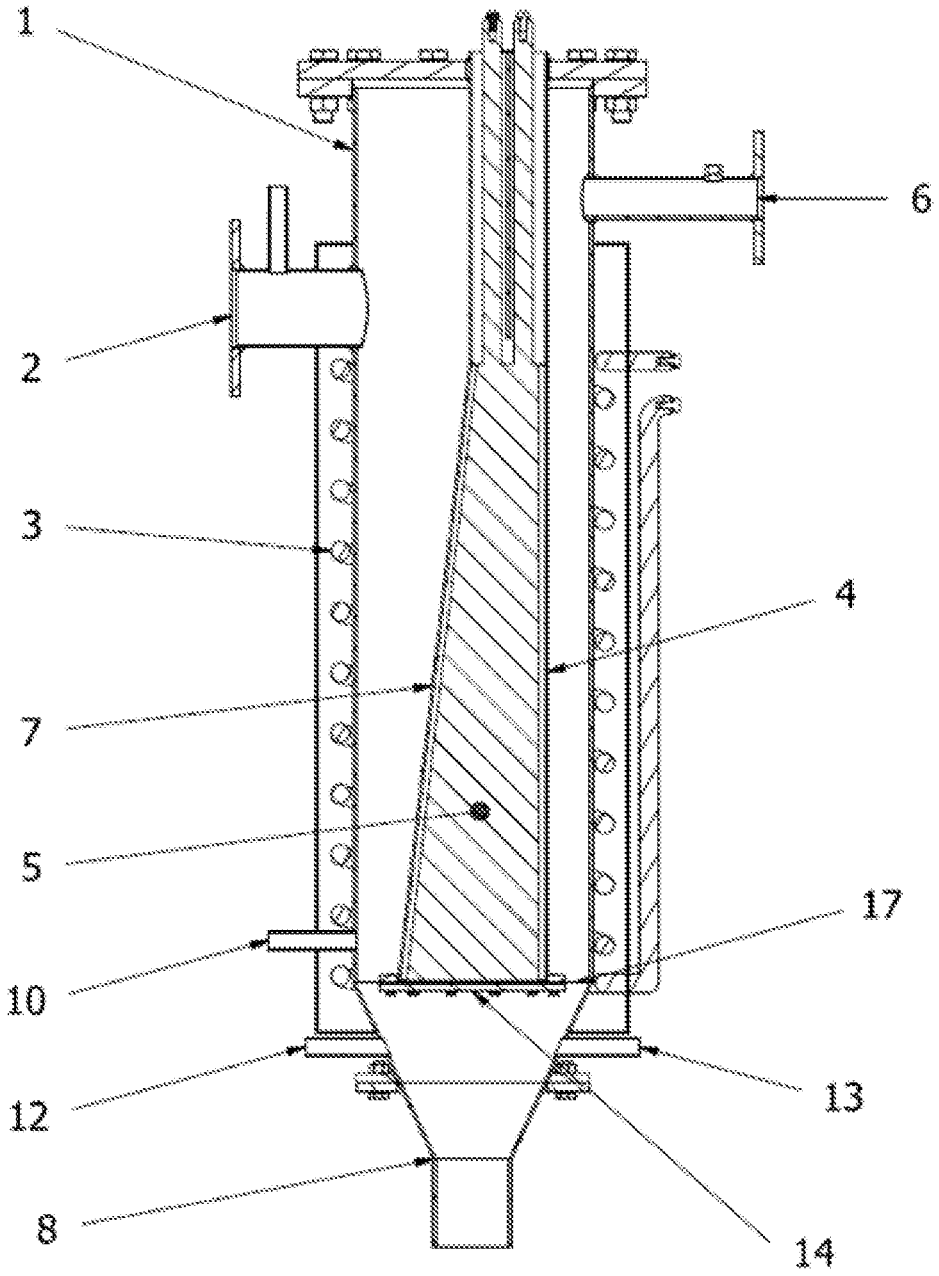
FIG. 4 shows a cross-sectional view of the gasifier in the embodiment wherein it comprises a dividing wall and the body has an eccentric cone configuration.
Figure 5:
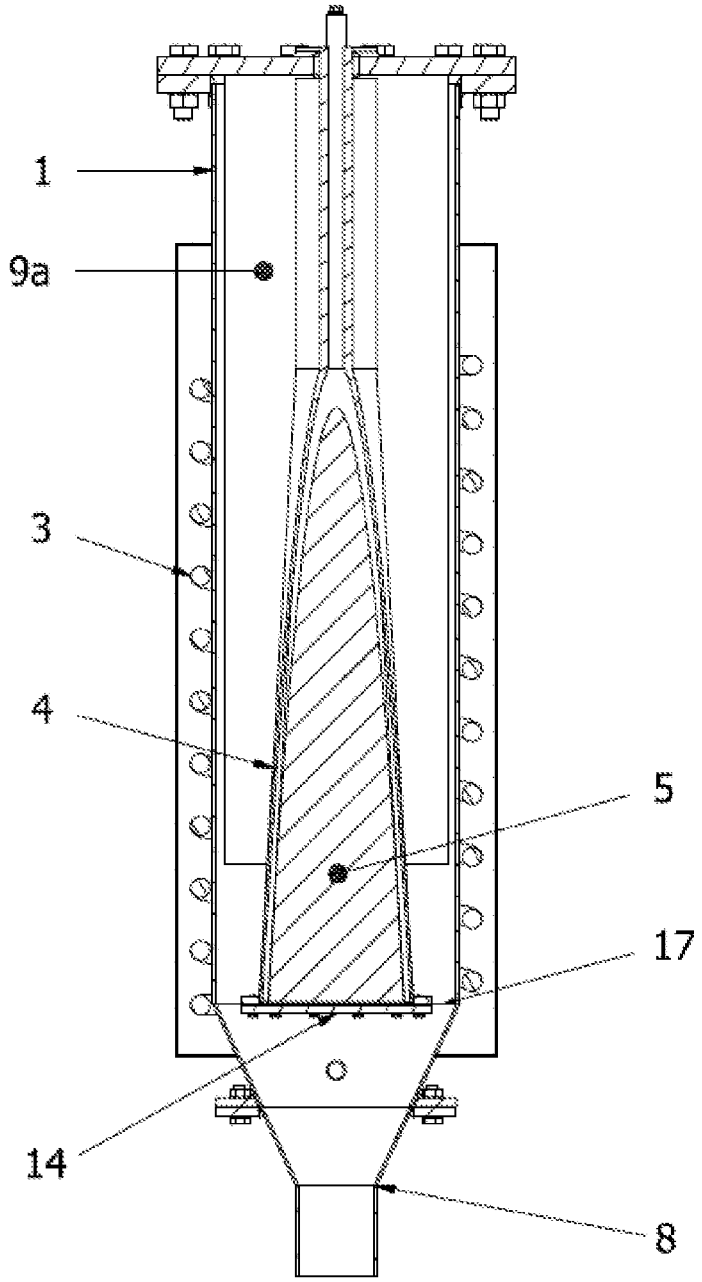
FIG. 5 shows another cross-sectional view of the gasifier of the embodiment of FIG. 4 wherein the dividing wall can be observed.

FIGS. 4 and 5 show sections of the gasifier in the first embodiment. FIG. 4 shows a detailed view of the inclined surface (7) of the body (4) which is disposed opposite to the inlet (2). In this case, since the body (4) is an eccentric cone, there is only one inclined surface (7). FIG. 5 shows another cross-sectional view wherein the dividing wall (9*a*) can be clearly observed.

In the second embodiment (shown in FIGS. 2B, 3B, 6, 7), since the revolution body (4) is preferably a concentric cone, the process geometry increases, i.e. the waste accumulation zone (15) around the revolution body (4) in contact with the inclined surfaces (7) increases with respect to the first embodiment. Likewise, since the evacuation tube (9*b*) is disposed in the interior of the revolution body (4), it does not occupy additional space in the interior of the receptacle (1). The length of the evacuation tube (9*b*) and the increase in the waste zone (15) are preferably determined based on the angle of repose on the inclined surfaces (7) of the body (4) of the waste to be treated.

The interior of the evacuation tube (9*b*) is the waste-free zone (16) in the second embodiment. In this second embodiment, during the passage of the syngas through the evacuation tube (9*b*), energy exchange takes place with the waste in the interior of the receptacle (since it is in contact with the revolution body).

Figure 6:
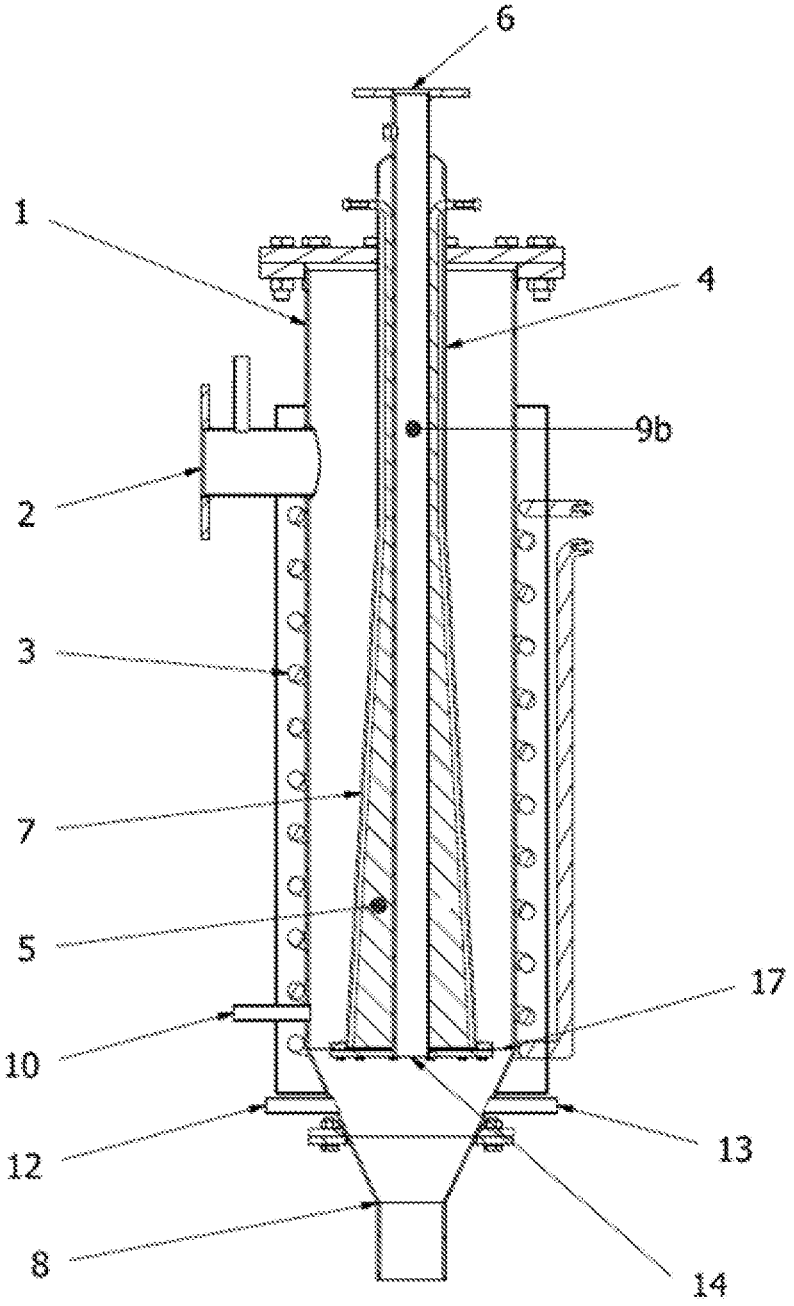
FIG. 6 shows a cross-sectional view of the gasifier in the embodiment wherein it comprises an evacuation tube and the body has a concentric cone configuration.
Figure 7:
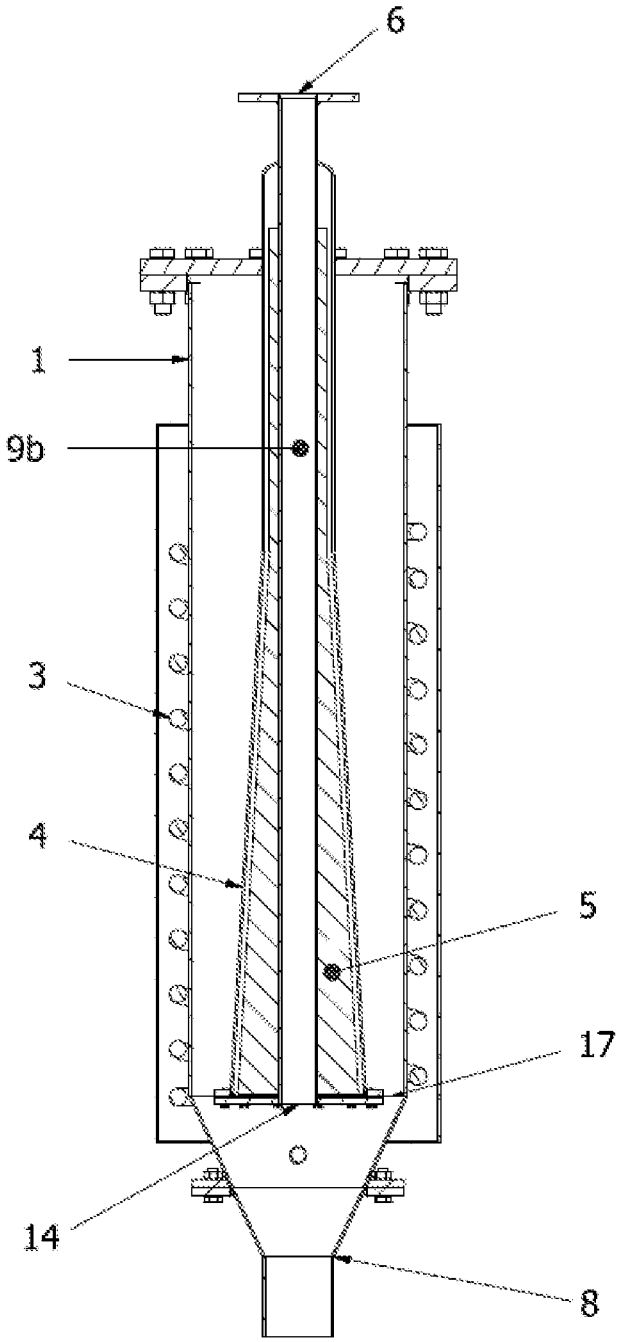
FIG. 7 shows another sectional view of the gasifier of the embodiment of FIG. 5.

FIGS. 6 and 7 show cross-sectional views of the gasifier in the second embodiment. FIG. 6 shows one of the inclined surfaces (7) of the body (4) disposed opposite to the waste inlet (2). FIG. 7, which represents another cross-sectional view of the same embodiment, shows the evacuation tube (9*b*) in the interior of the body (4), which connects the base (14) of the body (4) to the syngas outlet (6).

Figure 8A:
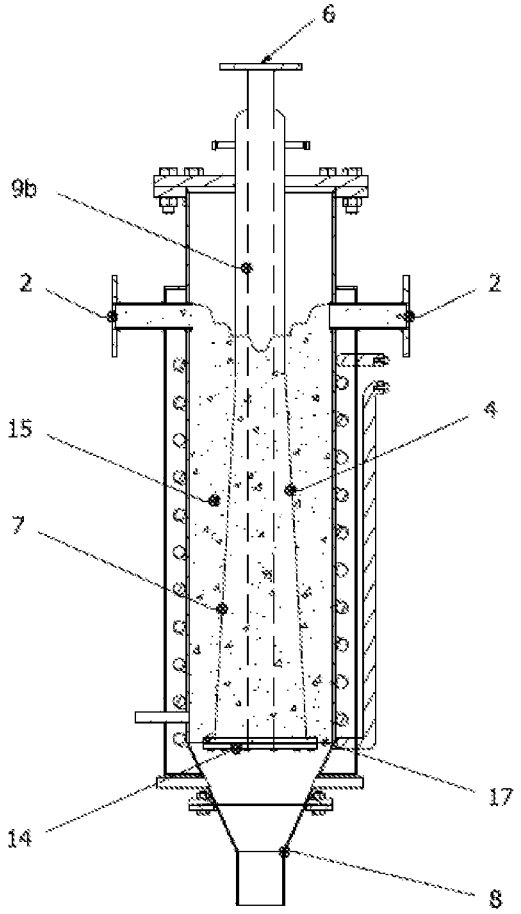
FIGS. 8A-B show a cross-sectional elevation view and a cross-sectional top view of an exemplary embodiment wherein the gasifier comprises an evacuation tube and two waste inlets.
Figure 8B:
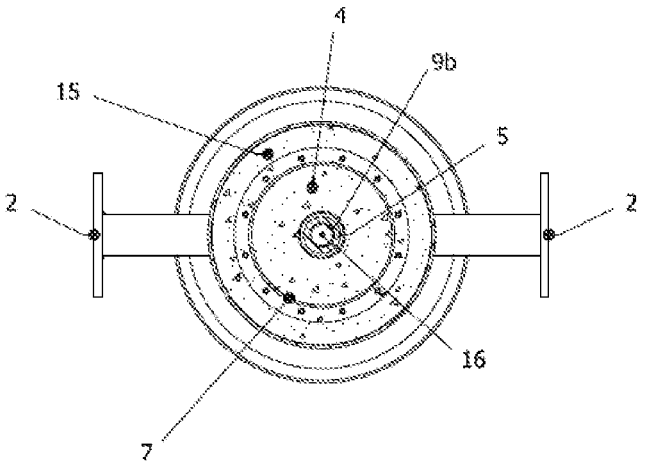

FIGS. 8A-B show an example wherein a gasifier with an evacuation tube (9*b*) (second embodiment) comprises two waste inlets (2). As can be observed in FIG. 8A, the inlets (2) are preferably disposed on the upper part of the receptacle (1) and in opposite positions to one another. This makes it possible to increase the capacity of the gasifier of the waste treatment unit. This embodiment is possible because, since the body (4) is a concentric cone, it comprises various inclined surfaces (7) that guarantee the proper distribution of the waste in the interior of the receptacle (1), even if the waste is introduced from different positions. FIG. 8B shows how, even though there may be two waste inlets (2), the evacuation tube (9*b*) continues to be a waste-free zone (16).

Additionally, in order to carry out the oxidation reactions of the waste in the receptacle (1), the gasifier further comprises heating means configured to heat the interior of said receptacle (1).

Figure 9A:
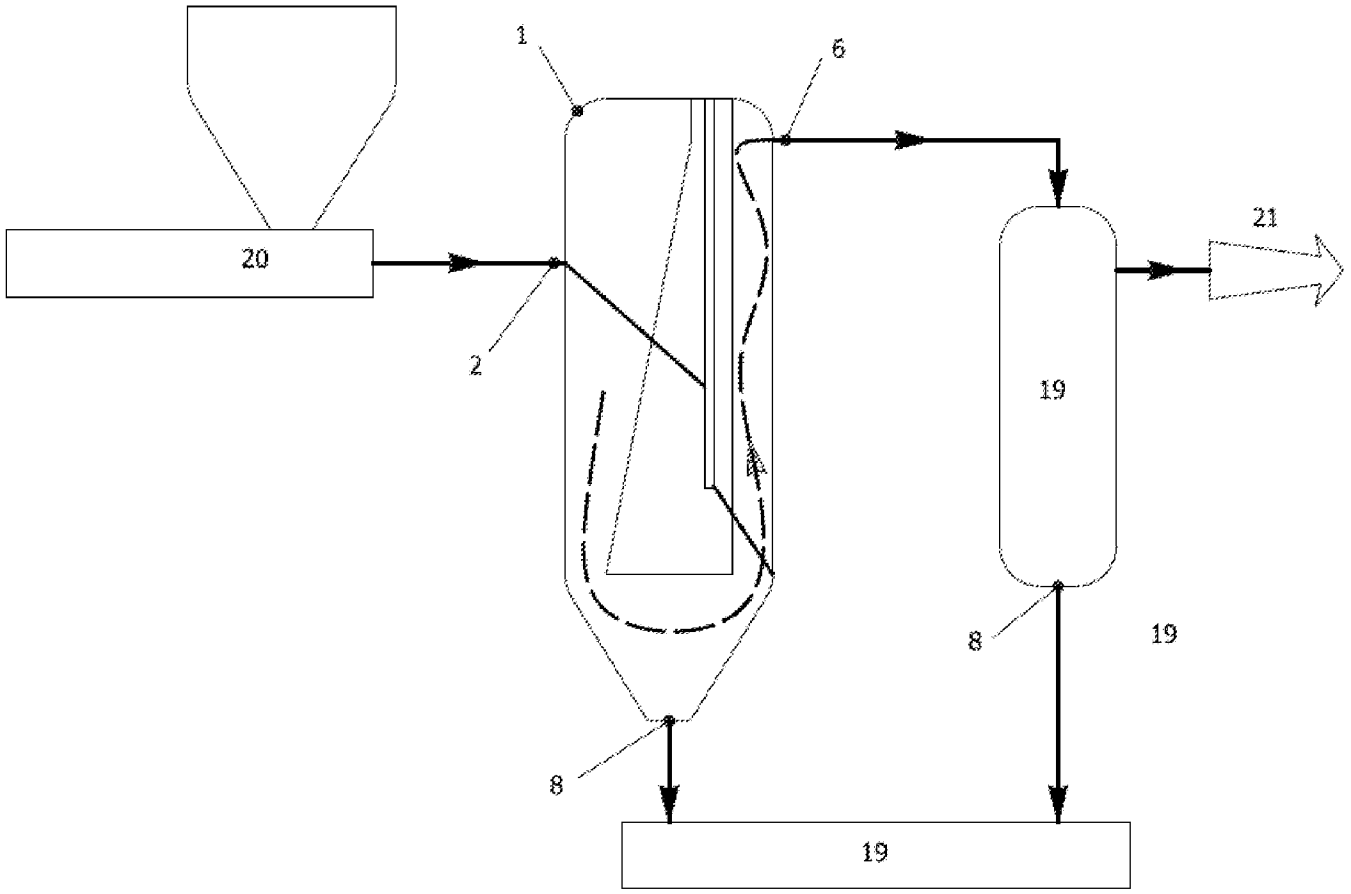
FIGS. 9A-B show a schematic view of the gasification unit with a gasifier and reformer in an embodiment wherein the gasifier comprises a dividing wall and in an embodiment wherein the gasifier comprises an evacuation tube.
Figure 9B:
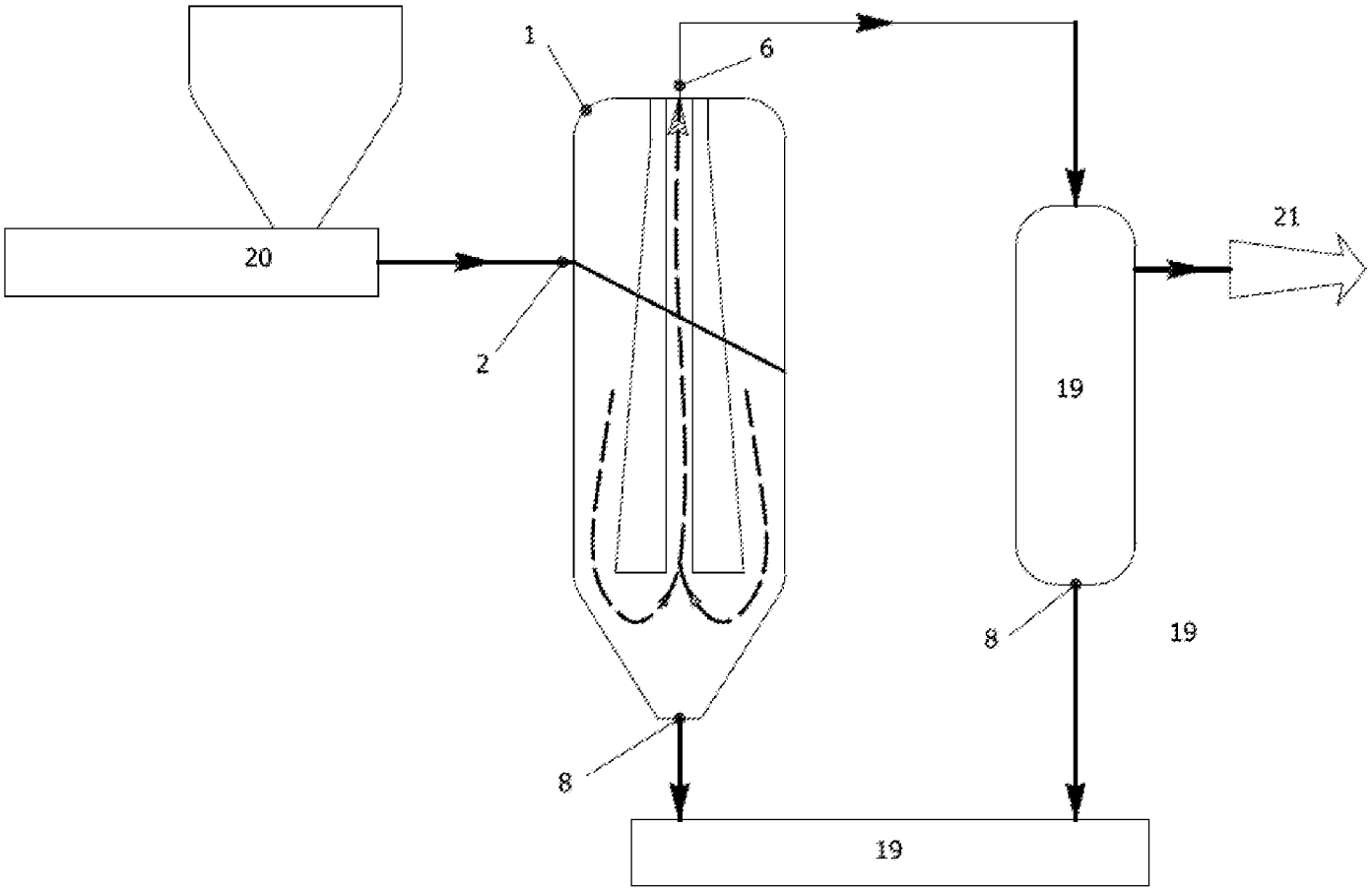

FIGS. 9A-B show a waste treatment unit that further comprises a reformer (18). The reformer (18) is preferably connected to the syngas outlet (6) of the gasifier. The unit has been represented with the gasifier according to the first embodiment (FIG. 9A) and with the gasifier according to the second embodiment (FIG. 9B). As can be observed, the fact that the gasifier is of one type or another does not interfere with the operation/distribution of the other elements of the unit.

In this case, a facility with a waste feeder (20) connected to the gasifier can be observed. The interior of the receptacle (1) of the gasifier has been represented with the body (4), the dividing wall (9) and a line that represents the accumulated waste. The path followed by the syngas through the interior of the receptacle (1) towards the syngas outlet (6) has been represented schematically to facilitate comprehension of the explanation provided. The connection of the ashtray outlet (8) to an ashtray (19) of the facility wherein the waste treatment unit is disposed is also shown.

Since in this example the waste treatment unit further comprises a reformer (18), it can be observed how the syngas follows a path from the gasifier to said reformer (18), wherein the necessary reforming reactions to obtain a purer syngas outlet (21) than that obtained at the syngas outlet (6) of the gasifier take place. The reformer (18) also has an ashtray outlet (8) which, as can be observed in FIG. 5, is connected to an ashtray (19) of the facility.

The heating means are disposed around the receptacle (1), are disposed in the interior of the receptacle (1) or a combination of both. FIG. 1 shows an embodiment wherein the heating means are internal heating means (5) disposed in the interior of the body (4), and external heating means (3), disposed around the receptacle (1).

In a possible embodiment wherein there are external heating means (3), said external heating means (3) extend from the waste inlet (2) to the waste depletion shaft (17). This makes it possible to heat only the section of the receptacle (1) where the waste is located.

In another exemplary embodiment, the external heating means (3) also extend along the ashtray outlet (8) to ensure the depletion of the carbonaceous waste and the eventual scorification of the ashes, if necessary.

The external heating means (3) preferably comprise a sleeve wherein an induction coil which acts on the receptacle (1) wall is housed. The internal heating means (5) preferably comprise an induction coil housed in the interior of the body (4) such that they act on the walls thereof, transferring heat to the interior of the receptacle (1). This is the preferred combination of heating means because it ensures that an adequate temperature is maintained in any point of the interior of the receptacle (1).

One of the technical characteristics of the gasifier, which gives it versatility, is that it can comprise different heating means. In a preferred exemplary embodiment, the heating means are induction coils because they enable instant start-up. In other exemplary embodiments, for example, electrical resistors or a combustion gas flow can be used.

The unit can operate under a self-regulated stratification regime regulated simply by controlling the temperature of the desired zones of the heating means.

The gasifier may further comprise, as observed, for example, in FIG. 1, at least one vapour injection inlet (10) for those cases wherein the waste has an insufficient amount of humidity, an emergency oxidising agent inlet (12) and an inertisation and emergency tripping unit (13). Likewise, the gasifier comprises the corresponding connections for controlling the pressure and temperature in the receptacle (1).

Some of the modifiable parameters of the gasifier of the present invention are the height of the receptacle (1), the diameter of the body (4), the angle of inclination of the inclined surface (7) and the waste depletion shaft (17). Modifying these parameters enables the waste treatment unit to be adapted.

The invention claimed is:

1. A waste treatment unit comprising:

at least one gasifier having a main receptacle with a waste inlet disposed in the upper section of the receptacle, a syngas outlet and an ashtray outlet, wherein the gasifier comprises:

a body comprising:

at least one inclined surface, disposed in the interior of the receptacle, with the inclined surface disposed opposite to the waste inlet and a base disposed such as to generate a depletion shaft between said base and walls of the receptacle that prevents the passage of waste;

a dividing wall disposed in the interior of the receptacle and in contact with the body, or an evacuation tube disposed in the interior of the body which comprises at least a first end corresponding to the syngas outlet and a second end disposed in the base of the body, the dividing wall or the evacuation tube separating a waste accumulation zone corresponding, at least, to said inclined surface and a waste-free zone wherethrough the syngas generated flows towards the outlet, such as to create a waste zone in the receptacle, that encompasses at least the zone wherein the inclined surface of the body is located and wherein the waste that enters through the waste inlet is accumulated, and a waste-free zone wherethrough the syngas produced during oxidation of the waste flows towards the syngas outlet, and heating means configured to heat the interior of the receptacle.

2. The waste treatment unit of claim 1, wherein when the waste treatment unit comprises an evacuation tube, the body has a concentric cone configuration.

3. The waste treatment unit of claim 1, wherein the heating means are disposed around the receptacle, are disposed in the interior of the receptacle or a combination of both.

4. The waste treatment unit of claim 1, wherein the heating means are disposed in the interior of the body.

5. The waste treatment unit of claim 4, wherein when the waste treatment unit comprises an evacuation tube, the heating means are disposed around the evacuation tube.

6. The waste treatment unit of claim 1, wherein the heating means are induction coils.

7. The waste treatment unit of claim 1, wherein the heating means comprise external heating means comprising a sleeve with an induction coil disposed around the receptacle.

8. The waste treatment unit of claim 7, wherein the external heating means extend from the waste inlet to the waste depletion shaft.

9. The waste treatment unit of claim 7 wherein the external heating means extend from the waste inlet to the ashtray outlet.

10. The waste treatment unit of claim 1, wherein the receptacle is cylindrical.

11. The waste treatment unit of claim 1, wherein when the waste treatment unit comprises a dividing wall, the body is an eccentric cone.

12. The waste treatment unit of claim 1, wherein the syngas outlet is disposed in the upper section of the receptacle.

13. The waste treatment unit of claim 1, wherein when the waste treatment unit comprises an evacuation tube, it comprises two waste inlets disposed diametrically opposite to each other in the upper section of the receptacle.

* * * * *